US007522027B2

(12) United States Patent
Calvert et al.

(10) Patent No.: US 7,522,027 B2
(45) Date of Patent: Apr. 21, 2009

(54) MAGNET ASSEMBLY AND A METHOD FOR CONSTRUCTING A MAGNET ASSEMBLY

(75) Inventors: Simon James Calvert, Botley (GB); Peter Jonathan Davis, Oxford (GB)

(73) Assignee: Siemens Magnet Technology Ltd., Witney (GB)

( * ) Notice: Subject to any disclaimer, the term of this patent is extended or adjusted under 35 U.S.C. 154(b) by 657 days.

(21) Appl. No.: 11/319,479

(22) Filed: Dec. 29, 2005

(65) Prior Publication Data

US 2007/0152785 A1 Jul. 5, 2007

(51) Int. Cl.
*H01F 5/00* (2006.01)

(52) U.S. Cl. ..... 335/299; 335/216

(58) Field of Classification Search ..... 336/96, 336/197, 198, 205, 208; 335/216, 299; 310/43, 310/45

See application file for complete search history.

(56) References Cited

U.S. PATENT DOCUMENTS 4,060,743 A * 11/1977 Weghaupt ..... 310/52
4,137,471 A * 1/1979 Sato et al. ..... 310/51
4,385,248 A * 5/1983 Laskaris ..... 310/52
4,462,152 A * 7/1984 Okamoto et al. ..... 29/598
4,500,860 A * 2/1985 Vermilyea ..... 335/216
4,642,503 A * 2/1987 Ueda et al. ..... 310/214
4,646,044 A * 2/1987 Kuno et al. ..... 335/299
4,658,170 A * 4/1987 Ueda ..... 310/214
4,895,831 A * 1/1990 Laskaris ..... 505/163
4,924,198 A * 5/1990 Laskaris ..... 505/211
4,935,714 A * 6/1990 Vermilyea ..... 505/211
5,111,172 A * 5/1992 Laskaris ..... 335/216

* cited by examiner

*Primary Examiner*—Ramon M Barrera
(74) *Attorney, Agent, or Firm*—Crowell & Moring LLP

(57) ABSTRACT

A magnet assembly comprising a former having an outer surface (20) with a cavity (12) formed therein, and a coil (14) wound into the cavity (12), said cavity being of greater depth than the coil, wherein the coil is overlain with a layer of filler material (18) of sufficient thickness that its outer surface at least aligns with the outer surface of the former (20); a clamp (22, 30) is provided, over at least part of the surface of the layer of filler material, and fastened to the outer surface of the former; and the filler material and the coil are impregnated with a solid material.

14 Claims, 2 Drawing Sheets

MAGNET ASSEMBLY AND A METHOD FOR CONSTRUCTING A MAGNET ASSEMBLY

The present invention relates to magnets comprising electrically conductive coils wound onto formers. More particularly, it relates to superconducting magnets having coils of superconducting wire wound onto a former, wherein the former is formed of a material having a greater coefficient of thermal expansion than the material of the wire. The present invention may be applied to solenoidal magnets, and to magnets having other structures, provided that they are wound onto a former. In particular, the present invention relates to magnet having coils wound into cavities formed on the outer surface of the former.

Superconducting magnets are known for use in nuclear magnetic resonance imaging, nuclear magnetic resonance spectroscopy or magnetic resonance imaging. While the magnet structures of the present invention may usefully be applied in these techniques, the present invention is in no way limited to these applications.

It is a requirement of such imaging techniques that a background magnetic field is produced which is extremely homogeneous spatially, and temporally stable. In a known superconducting magnet, whether of solenoidal or other construction, the magnet is typically formed of a plurality of individual conductive coils, electrically connected in series. In operation, strong magnetic forces act on the coils, and a robust mechanical arrangement must be provided to hold the coils in place. When operating current is applied to the magnet, known as ramp-up, these forces will develop on the coils, and the coils will have a tendency to move and/or deform under these forces. When current is removed from the coils, the forces diminish, and the coils will tend to return to their original positions.

To generate an acceptable quality of field for present imaging purposes, the positional accuracy of the coils must be maintained from one ramp-up to the next with a very high precision. Shifts of only a few microns in the relative position of the coils will degrade the quality of the magnetic field produced, and so may degrade the images produce in an associated imaging system.

One known arrangement for ensuring the precision location of the various coils is to select materials for the coils and for the former whereupon they are wound such that the coefficients of thermal expansion of the coils and the former are closely matched. In such arrangements, it is necessary that the coils stay in contact with the former when cooled, and also during ramp-up, ramp-down and operation. This has involved the use of composite materials such as glass reinforced plastic, or other materials such as stainless steel, for the former. Such materials have been found to be expensive. Alternatively, more complex mechanical retention means have been provided, allowing relatively inexpensive materials such as aluminium and aluminium alloys to be used for the former. Such embodiments may employ "external former" coils, where the former has a greater coefficient of thermal expansion than the material of the coils, but being situated externally of the coils, this difference in thermal expansion coefficients is advantageous in clamping the coils more tightly in their respective positions when the assembly is cooled.

In other known arrangements using aluminium or aluminium alloy formers, no particular coil retention means are provided. When the magnet is cooled, a gap develops between the inner diameter of the coil and the surface of the former, due to the former's greater coefficient of thermal expansion. Such gap may be in the order of tenths of a millimeter, for example 0.3 mm. The coil will become loose on the former, and will tend to fall under gravity such that it contacts the former on its inner diameter of the upper portion. This will mean that the coil is no longer concentric with the former. In a typical magnet having several coils of unequal sizes, this may mean that the coils are no longer coaxial, which will in turn degrade the spatial homogeneity of the resultant magnetic field. In operation, magnetic forces will act on the coils, tending to extend them in their radial direction. This may cause the coils to deform outwards, increasing the gap between the inner diameter of the coils and the surface of the former. In addition to the thermal deformation, this deformation due to magnetic force will increase the likelihood of radial misalignment of the coils in operation, particularly because the mechanical strain in each coil may be different due to the properties of each coil, and the local magnetic field strength.

The effects of the above-described deforming forces, generated in operation by the generated magnetic field, are known as 'ramp shift' homogeneity issues, and typically affect all coils. In addition, when the magnet is in operation for purposes such as imaging, other coils are used. For example, gradient coils are often used with pulsed activation. During the pulsed activation, corresponding pulses of radial force will be applied to the coils of the magnet. These may cause the coils to deform, or shift. Such gradient coil induced shift is believed to be significant only in relation to central coils of the magnet. In more axially eccentric coils, axial forces on the coils tend to hold them in position more securely when in operation. The shifts in coil position caused by gradient coil pulsing may also have a detrimental effect on the spatial homogeneity of the resultant magnetic field, but since the gradient field induced forces are periodically applied, the gradient field induced shift may also detrimentally affect the temporal stability of the magnetic field of the magnet.

Prior art arrangement have tended to follow one of two alternative solutions—either to make sure that the coil remains firmly on the former, by careful selection of materials and/or mechanical constraints, ensuring that no movements may occur which could cause a quench, or else allowing the coils to move freely, despite any possible effect on magnetic field quality, such that any relative movement of the coils and the former does not dissipate any appreciable heat.

The present invention aims to alleviate at least some of the disadvantages of the prior art solutions, to allow relatively low-cost materials to be used for the former. Of particular interest is the use of aluminium or an alloy comprising at least 50% aluminium, as the material of the former. Such materials are relatively inexpensive and lightweight.

The present invention accordingly provides methods and/or apparatus as set out in the appended claims.

The above, and further, objects, characteristics and advantages of the present invention will become more apparent by consideration of the following description of certain embodiments thereof, given by way of examples only, in conjunction with the accompanying drawings, wherein.

As is known, superconducting magnet coils are susceptible to quench events. Even a small input of energy at a certain point in a superconducting coil may be sufficient to cause a part of the superconducting wire to become normal, that is, resistive. Once a small part has become resistive, then the current flowing in the coil will cause further heating of the resistive part of the wire. That heating will in turn cause more of the wire to become resistive. The situation continues until all of the energy stored in the superconducting coil has been dissipated in heat. It is of course important to avoid such events happening randomly, in so far as is possible.

As described above, it is known that superconducting coils are subjected to large forces when in operation as part of a magnet structure. Should a part of a coil move suddenly as a result of the operational forces on the coil suddenly overcoming a frictional interaction between the coils and the former, enough energy may be dissipated to cause a quench in the coil. For this reason, it is desired either to arrange the coils such that they cannot move on the former at all, or else to arrange the coil such that it may move easily of the former without dissipated energy. The first of these is typically achieved with various mechanical clamping arrangements, clamping coils onto a former having a coefficient of thermal expansion which is closely matched to the coefficient of thermal expansion of the coils. The second option is typically arranged by providing a release layer of low friction material such as polytetrafluoroethylene (PTFE) between each coil and the adjacent surfaces of the former.

The present invention enables the use of low cost former materials having coefficient of thermal expansion different from those of the coils. In particular, this is arranged by providing coils wound on an inner former, with mechanical constraints acting on the outer surface of each coil over at least substantially the whole circumference of each coil. Such mechanical constraints ensure that the various coils remain accurately located in their respective relative positions, and that any movement of the coils relative to the former is precisely repeatable in successive ramp-up and ramp-down operations. The mechanical constraints are further provided with means to ensure that any movement of the coils relative to the former takes place gradually, such that there is little likelihood of a sudden movement of the coil leading to a quench.

Figure 1:
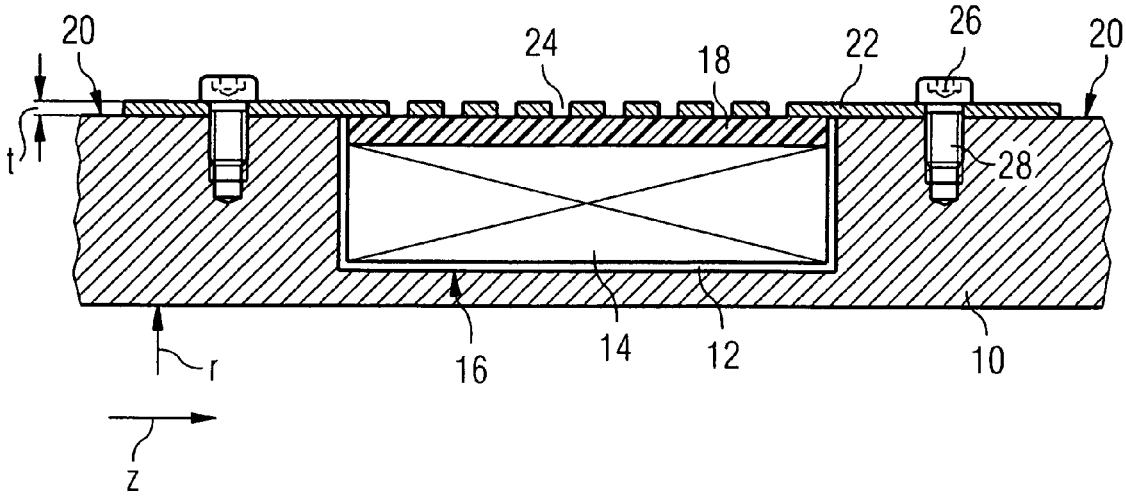
FIG. 1 illustrates a cross-section of a coil and former arrangement according to a first embodiment of the present invention.

FIG. 1 illustrates a partial cross-section through a coil 14 wound on a former 10 according to the present invention. The former and the coil are substantially rotationally symmetric about a cylindrical volume defined by radius r. Radius r defines a radial direction, and the axis of the cylinder, parallel to direction Z shown in FIG. 1, defines the axial direction. The terms radial and axial will be used in the following description to define directions respectively perpendicular and parallel to the axis of the cylindrical volume. A former 10 is shown which may be of a relatively inexpensive material such as aluminium or an aluminium alloy comprising at least 50% aluminium. A cavity 12 is provided, to receive a coil 14 in the conventional manner. The cavity is somewhat deeper than the thickness of the coil to be formed therein. A release layer 16 of low friction material such as polytetrafluoroethylene (PTFE) is provided, lining the cavity 12 to lie between the former and the coil. As is conventional, the wire of coil 14 is wound onto the former. When the winding is complete, a resin impregnation process is performed to resin impregnate the coil. According to an aspect of the present invention, the resin-impregnated coil is not in direct contact with the former 10, but is separated therefrom by layer 16 of low friction material.

Once the resin impregnation has hardened, a filler material such as woven glass tape 18 is wound over the coil, to at least substantially fill the remaining depth of the cavity 12, and preferably to rise slightly proud of the surrounding surface 20 of the former 10.

A clamp 22 is then affixed over the layer of filler material. This clamp may be of a material such as aluminium or another metal. Preferably, the material of the clamp is chosen to have a coefficient of thermal expansion close to that of the material of the former. For example, the clamp 22 may be of sheet aluminium with a thickness t of about 2 mm. The clamp is preferably perforated with perforations 24 at least in the region which lies over the filler material. The clamp is sufficiently wide that a portion of the clamp lies over the surrounding surface 20 of the former. Radially-oriented clamping screws 26 pass through holes in the clamp to engage with corresponding threaded holes 28 in the former. Alternative means for attaching the clamp to the former may be provided, such as through-bolts, welding of the clamp to the former, or tension banding around the outer surface of the clamps.

A second impregnation step is then performed. The filler material 18 is impregnated with paraffin wax or similar. The material used for this second impregnation should be friable and have a relatively low thermal conductivity.

When the magnet is cooled to cryogenic temperatures for superconducting operation, the coil 14 will contract less than the former. This will result in a force bearing on the inner surface of the clamp 22 due to the differences in expansion. This may result in a deformation of the clamp. In operation, the coil 14 will be subject to radial forces which will also tend to deform the coil in the radial direction. These effects will cause relative motion between the coil 14 and the former 10. Since the interfaces between the coil and the former are coated with release layer 16, the coil and the former will be able to move easily with respect to one another without dissipating heat which could lead to a quench in the coil. The impregnated filler material 18 may be keyed to the clamp by the presence of impregnating material within the perforations 24. Relative motion between the clamp and the coil may cause the impregnating material within the perforations to shear away from the impregnated filler material 18. The impregnating material must be friable such that this may occur without dissipating a significant amount of energy, which could lead to a quench in the coil 14. The relative motion between the clamp and the coil will nevertheless cause a certain dissipation of energy at their interface. The corresponding surface of the clamp may be coated with a release material such as polytetrafluoroethylene (PTFE) to reduce this dissipation of energy. Furthermore, the filler material 18 and the associated impregnating material should be chosen to have a relatively low thermal conductivity, as compared to the thermal conductivity of the material of the clamp 22, so that any heat generated at the interface between the clamp and the filler material 18 will flow primarily through the material of the clamp to the former, avoiding the coil. This is important again to avoid a quench in the coil.

The clamp may be formed of a single piece, or several pieces. It covers at least substantially the entire outer circumference of the layer of filler material. Preferably, the clamp is formed of at least three, and more preferably at least four parts. If the clamp were made of a single loop, it would be very difficult to install. Were the clamp made of a single piece wrapped around the former, the coil 14 would be likely to deform in operation in the region of the join of the two ends of the former, giving the coil a slight egg-shape. This would be detrimental to the homogeneity of the resultant magnetic field. By providing at least three and more preferably at least four parts to the clamp, any deformation of the coil at joins of the parts of the clamp will be more evenly distributed around the circumference of the coil, reducing any effect on the homogeneity of the resultant magnetic field. The design of the clamp in terms of material thickness, screw number and screw position may be optimised by finite element analysis to ensure that the clamp behaves elastically and that the coil distortion is acceptable. The material and thickness of the clamp must be chosen so that the range of distortion experienced by the clamp does not cause the clamp to become permanently deformed.

As the coil 14 and the former are cooled to cryogenic temperature, and further as current is introduced into the coil during ramp-up, a gap opens up between the inner diameter of the coil 14 and the outer diameter of the former 10 in the cavity 12. This relative motion causes the clamp 22 to flex outwards, being held in place by the screws 26. This has been found effective to fully constrain the coil. Since the clamp is provided around at least substantially the entire circumference of the coil, the coil is retained in an axially aligned position, since an at least substantially equal gap opens up between the coil and the former at all points on the circumference of the coil. Since all coils of the magnet which are wound onto the former are preferably provided with the present invention, all of these coils remain in axial alignment, improving the spatial homogeneity and the temporal repeatability of the resultant magnetic field. The outward flexing of the clamp under the force from the coil has been found sufficient to retain the coil in the axial direction. The difference in thermal expansion coefficients between the material of the former and the material of the coil will, in any case, have relatively little effect in the axial direction as opposed to the radial direction. The axial extent of the coil shown may be in the region of 10 cm, while the inner radius r of the former will typically be 1 m or more.

While the above-described process is relatively complex, in that two separate impregnation steps are required, it is believed to represent a useful compromise using common materials. Paraffin wax has been found to be a useful material for impregnation of the filler layer 18, in that it is not brittle; it allows movement to occur and does not crack. These characteristics reduce the chance of a movement due to the impregnating material of sufficient violence to cause quench of the coil. However, if a single impregnation step were used with paraffin wax as the impregnating material, the coil would be held together with paraffin wax, which has been found to have less resistance to mechanical movement than a resin impregnating material. Resin is found to be more reliable as an impregnating material for the coils. On the other hand, if a single impregnation step were employed using a resin impregnating material, the impregnated coil and filler material would be keyed to the clamp by impregnating material in the perforations of the clamp, impeding relative movement between the clamp and the impregnated coil structure. The coil would be unlikely to return to the same position with respect to the coil after operation, deteriorating the temporal stability of the resultant magnetic field. The resin would also bond to the underside of the clamp, requiring the provision of a release coating, such as polytetrafluoroethylene (PTFE) on the underside of the clamp. Since the resin would harden to a relatively brittle, stiff material, and movement of the coil would be likely to be relatively violent, leading to an increased chance of coil quench.

Figure 2:
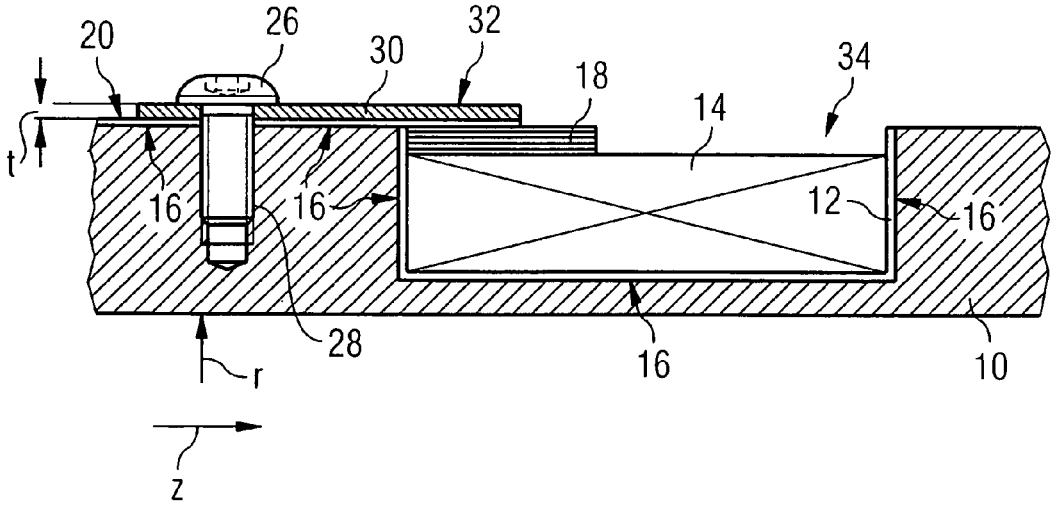
FIG. 2 illustrates a cross-section of a coil and former arrangement according to a second embodiment of the present invention.

FIG. 2 illustrates a partial cross-section through a coil wound on a former according to another embodiment of the present invention. As in the above-described embodiment, a former 10 is provided with a cavity 12 to receive a coil 14 in the conventional manner. The cavity is somewhat deeper than the thickness of the coil to be formed therein. A release layer 16 of low friction material such as polytetrafluoroethylene (PTFE) is provided, lining the cavity 12 to lie between the former and the coil. As is conventional, the wire of coil 14 is wound onto the former. When the winding is complete, a partial layer of a filler material such as 25 mm or 50 mm wide woven glass tape 18 is wound over a selected portion of the surface of the coil 14, next to at least one axial end of the coil. The filler material 18 is wound to at least substantially fill the remaining depth of the cavity 12, in the selected portion. Preferably, the filler material 18 is provided to such a thickness that it rises slightly proud of the surrounding surface 20 of the former 10. The filler material may be any type of filler that can be bonded to the coil and that has a low thermal conduction.

A clamp 30 is then affixed over at least part of the surface of the partial layer 18 of filler material. This clamp may be of a material such as aluminium or another metal. Preferably, the material of the clamp is chosen to have a coefficient of thermal expansion close to that of the material of the former. For example, the clamp 30 may be of sheet aluminium with a thickness t of about 2 mm. In this embodiment, the clamp should not be perforated. The clamp is sufficiently wide that a portion of the clamp lies over the surrounding surface 20 of the former. The clamp 30 extends over a portion of the surrounding surface 20 of the former 10, at least to a distance sufficient to provide holes enabling screws 26 or other fastening means to securely attach the clamp to the former. Radially-oriented clamping screws 26 pass through holes in the clamp to engage with corresponding threaded holes 28 in the former. Alternative means for attaching the clamp to the former may be provided, such as through-bolts, welding of the clamp to the former, or tension banding around the outer surface of the clamps.

A resin impregnation process is then performed to resin impregnate the coil and the partial layer of filler material 18, in a single step. The filler material 18 reduces shrinkage of the resin on curing, and also reduces the thermal conductivity between the clap and the coil. It has been found that effective impregnation may be achieved through the exposed surfaces of the coil and the partial filler layer. The resultant structure is a coil and filler as a single, integral resin-filled component. According to an aspect of the present invention, the resin-impregnated coil is not in direct contact with the former 10, but is separated therefrom by layer 16 of low friction material. The underside of the clamp 30 should be provided with a release layer such as polytetrafluoroethylene (PTFE), such that the resin used does not bond to the clamp 30. If the clamp were perforated, the resin impregnated filler material would be keyed to the clamp, impeding relative motion of clamp and coil which is not desired since this could result in sudden violent motion, which may cause a coil to quench.

The clamp 30 may be formed of a single piece, or several pieces. It covers at least substantially the entire outer circumference of the partial layer of filler material 18, across at least part of its axial width. Preferably, the clamp is formed of at least three, and more preferably at least four, parts. If the clamp were made of a single loop, it would be very difficult to install. Were the clamp made of a single piece wrapped around the former, the coil 14 would, in operation, be likely to deform in the region of the join of the two ends of the clamp, giving the coil a slight egg-shape. This would be detrimental to the spatial homogeneity of the resultant magnetic field. By providing at least three, and more preferably at least four, preferably equal, parts to the clamp, any deformation of the coil at joins of the parts of the clamp will be more evenly distributed around the circumference of the coil, reducing any effect on the homogeneity of the resultant magnetic field. The design of the clamp in terms of material thickness, number and position of retaining screws 26 may be optimised by finite element analysis to ensure that the clamp behaves elastically and that the coil distortion is acceptable. The material and thickness of the clamp 30 must be chosen so that the range of distortion experienced by the clamp does not cause the clamp to become permanently deformed. The material and design of the clamp, and the position of the screws 26 must be such that sufficient resilience is provide to ensure that the coils are held in place, without being excessively rigid such that the coils may be pushed out of round, which may distort the resultant magnetic field or cause quench. High-strength 7075T6-grade aluminium sheet of approximately 2 mm thick has been found to be a suitable material for the clamps 30. For aluminium clamps, the release coating may be a deposited layer of PTFE, or any other known release agent compatible with the material of the clamps.

As the coil 14 and the former 10 are cooled to cryogenic temperature, and as current is introduced into the coil 14 during ramp-up, a gap opens up between the inner diameter of the coil 14 and the outer diameter of the former 10 in the cavity 12. This relative motion causes the clamp 30 to flex outwards, being held in place by the screws 26. This has been found effective to fully constrain the coil. Since the clamp is provided around at least substantially the entire circumference of the coil, the coil is retained in an axially aligned position, since an at least substantially equal gap opens up between the coil and the former at all points on the circumference of the former. Since all coils of the magnet which are wound onto the former are preferably provided with the present invention, all of these coils remain in axial alignment, improving the spatial homogeneity and the temporal repeatability of the resultant magnetic field. The difference in thermal expansion coefficients between the material of the former and the material of the coil will have relatively little effect in the axial direction as opposed to the radial direction. The axial extent of the coil shown may be in the region of 10 cm, while the inner radius r of the former will typically be 1 m or more.

Figure 3:
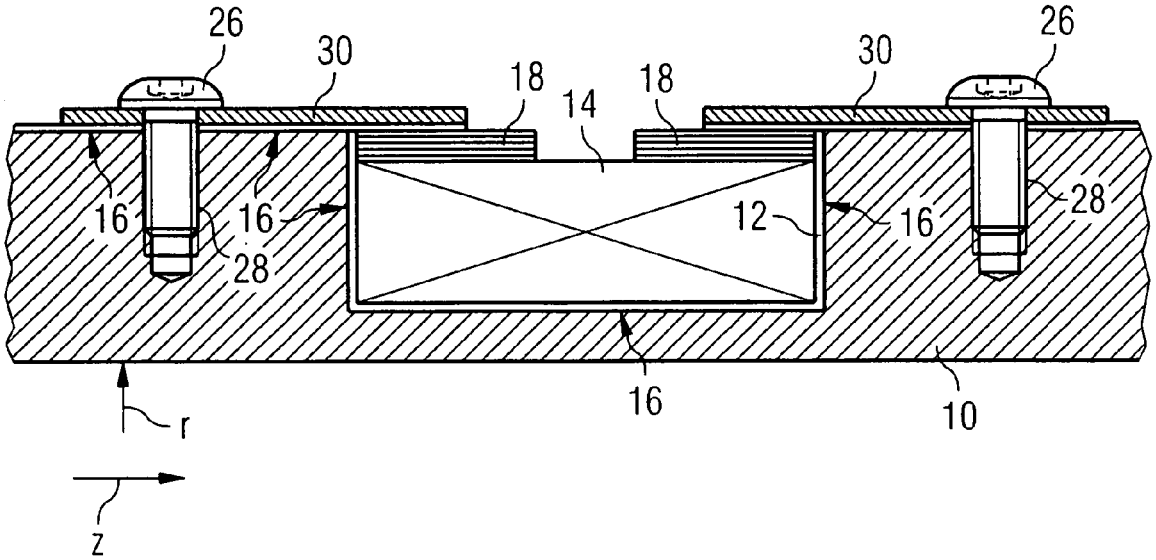
FIG. 3 illustrates a cross-section of a coil and former arrangement according to a third embodiment of the present invention.

In the embodiment illustrated in FIG. 2, most of the force exerted on the clamp will occur in a band around the axial end of the coil nearest the retaining screws, said band being shown at 32. Since the clamp is free to flex away from the coil, relatively little force can be held at regions of the clamp axially further from the retaining screws 26. This may be found to be detrimental in some embodiments, in that the coil may deform such that the coil part 34 axially distant from the retaining screws 26 will deform away from the former 10 to a greater extent than the part 32 nearest the retaining screws. This may particularly be the case when the coils are relatively thin in the radial direction as compared to their axial extent. In such embodiments, a corresponding arrangement of filler material 18 and clamp 32 may be provided at both axial ends of the coil. Such an embodiment is illustrated in FIG. 3. Such embodiments are effective, but are also more expensive and more complex to assemble than arrangements such as shown in FIG. 2.

The invention claimed is:

1. A magnet assembly comprising a former having an outer surface (20) with a cavity (12) formed therein, and a coil (14) wound into the cavity (12), said cavity being of greater depth than the coil, wherein:

the coil is overlain with a layer of filler material (18) of sufficient thickness that its outer surface at least aligns with the outer surface of the former (20);

a clamp (22, 30) is provided, over at least part of the surface of the layer of filler material, and fastened to the outer surface of the former;

the filler material and the coil being impregnated with a solid material.

2. A magnet assembly according to claim 1 wherein the former is of a material having a coefficient of thermal expansion greater than the coefficient of thermal expansion of the material of the coil.

3. A magnet according to claim 1 wherein the filler layer extends over substantially the entire outer surface of the coil and the clamp (24) extends across the cavity and is fastened to the former on both sides of the cavity, said clamp being perforated, at least in a region covering the layer of filler material.

4. A magnet according to claim 3 wherein the coil is impregnated with a thermosetting resin material and the filler layer is impregnated with a wax.

5. A magnet according to claim 1 wherein the filler layer extends over only an axial part of the outer surface of the coil and the clamp (30) extends at least partially over the layer of filler material and only partially across the cavity and is fastened to the former on only one side of the cavity.

6. A magnet according to claim 5, further provided with a similar filler layer extending over a second axial part of the outer surface of the coil and a second clamp (30) extends at least partially over the second layer of filler material and only partially across the cavity and is fastened to the former on the other side of the cavity.

7. A magnet according to claim 5 wherein the coil and the filler layer are both impregnated with a thermosetting resin material.

8. A magnet according to claim 1, wherein a release layer (16) is provided, lining the cavity between the former and the coil.

9. A magnet according to claim 1, wherein a release layer is provided, coating a surface of the clamp in contact with the filler layer.

10. A method for constructing a magnet assembly comprising a former having an outer surface (20) with a cavity (12) formed therein, and a coil (14) wound into the cavity (12), said cavity being of greater depth than the coil, comprising the steps of:

winding the coil into the cavity;

overlaying the coil with a layer of filler material (18) of sufficient thickness that its outer surface at least aligns with the outer surface of the former (20);

providing a clamp (22, 30) over at least part of the surface of the layer of filler material, and fastening the clamp to the outer surface of the former;

impregnating the filler material and the coil with a material which becomes solid.

11. A method according to claim 10 wherein the filler layer extends over substantially the entire outer surface of the coil and the clamp (24) extends across the cavity and is fastened to the former on both sides of the cavity, said clamp being perforated, at least in a region covering the layer of filler material, such that the filler layer may be impregnated through the perforated clamp.

12. A method according to claim 11 wherein the coil is impregnated with a thermosetting resin material prior to the application of the filler layer, and the filler layer is later impregnated with a wax.

13. A method according to claim 10 wherein the filler layer is provided over only an axial part of the outer surface of the coil and the clamp (24) extends at least partially over the layer of filler material and only partially across the cavity and is fastened to the former on only one side of the cavity.

14. A method according to claim 10 wherein the coil and the filler layer are both impregnated with a thermosetting resin material.

* * * * *